US006932449B2

(12) United States Patent
Collins et al.

(10) Patent No.: US 6,932,449 B2
(45) Date of Patent: Aug. 23, 2005

(54) MULTI-FUNCTIONAL BEVERAGE STORAGE RACK FOR A REFRIGERATOR

(75) Inventors: Clint J. Collins, North English, IA (US); Jeffrey O'Halloran, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/365,403

(22) Filed: Feb. 13, 2003

(65) Prior Publication Data

US 2004/0160151 A1 Aug. 19, 2004

(51) Int. Cl.[7] ..... A47B 96/04

(52) U.S. Cl. ..... 312/405.1; 312/408; 211/59.2; 211/85.4

(58) Field of Search ..... 211/85.18, 74, 211/85.4, 59.2; 312/408, 351, 405.1; D7/701, 619.1; 248/311.2, 316.8

(56) References Cited

U.S. PATENT DOCUMENTS

| | | | | | |
|---|---|---|---|---|---|
| 2,065,116 | A | * | 12/1936 | Constantine et al. | 108/26 |
| 2,140,611 | A | * | 12/1938 | Smith et al. | 108/26 |
| 2,231,817 | A | * | 2/1941 | Quimper | 62/382 |
| 2,984,533 | A | * | 5/1961 | Sundberg | 312/408 |
| D198,488 | S | | 6/1964 | Reis | |
| 3,797,903 | A | * | 3/1974 | Traulsen | 312/116 |
| 3,814,293 | A | | 6/1974 | Horne | |
| 4,515,334 | A | | 5/1985 | Horne | |
| 4,998,628 | A | | 3/1991 | Ross | |
| D330,147 | S | | 10/1992 | Garber | |
| D336,005 | S | | 6/1993 | Keup | |
| 5,323,917 | A | | 6/1994 | Johnson et al. | |
| 5,624,043 | A | * | 4/1997 | Baptista | 211/74 |
| 5,626,407 | A | * | 5/1997 | Westcott | 312/408 |
| 5,788,090 | A | * | 8/1998 | Kajiwara | 211/59.2 |
| 6,003,693 | A | * | 12/1999 | Blickenstaff | 211/74 |
| D425,375 | S | | 5/2000 | Parham | |
| 6,119,876 | A | * | 9/2000 | Lacourse | 211/74 |
| 6,230,906 | B1 | * | 5/2001 | Padiak et al. | 211/85.18 |
| 6,290,074 | B1 | | 9/2001 | Syvuk et al. | |
| 6,739,461 | B1 | * | 5/2004 | Robinson | 211/59.2 |

* cited by examiner

*Primary Examiner*—Milton Nelson, Jr.
(74) *Attorney, Agent, or Firm*—Diederiks & Whitelaw, PLC

(57) ABSTRACT

A beverage rack is configured to selectively store cylindrical cans, a series of bottles, or a single wine bottle in a refrigerator. More specifically, the beverage rack is provided with an elongated cavity for holding a wine bottle, a pair of spaced ledges for supporting a plurality of cans, and a set of ridges on longitudinal walls which accommodate a series of medium size bottles. With this arrangement, a consumer has the flexibility to choose the particular type of beverages to be stored and organized on a single rack. The rack is preferably injection molded of plastic and can be placed in various locations within a refrigerator compartment, such as on a shelf or in a drawer.

20 Claims, 3 Drawing Sheets

MULTI-FUNCTIONAL BEVERAGE STORAGE RACK FOR A REFRIGERATOR

BACKGROUND OF THE INVENTION

1. Field of the Invention

The present invention pertains to the art of refrigerators and, more particularly, to a rack for storing a variety of beverage containers in a refrigerator.

2. Discussion of the Prior Art

In a typical household, it is often necessary to refrigerate, in addition to a host of food items, a variety of beverages simultaneously. Of course, it is desirable to organize the beverages in order to minimize the required storage space and to enhance the accessibility of the beverages. For this purpose, it is known to employ a rack in a refrigerator in order to house beverages. A rack constructed in accordance with the known prior art is generally configured for use with a single, particularly shaped type of beverage container. For instance, it is common to employ a rack which is adapted to hold a series of 12 ounce cylindrical soft drink cans in a refrigerator, with the cans being automatically fed to a dispensing end of the rack. It is also known to employ a rack to support one or more wine bottles, as well as a rack to support other bottled beverages.

Regardless of the existence of these prior art arrangements, given that beverages are commonly stored in containers which can greatly vary in shape and size, the known racks are not considered to be very versatile. That is, conventional refrigerator racks are typically designed for use in supporting only one type of beverage container. Although there exists racks which are actually configured to support two different types of beverage containers, there still exists a need in the art for a multi-functional beverage rack which can be used to support a wider range of conventional beverage containers.

SUMMARY OF THE INVENTION

The present invention is directed to a multi-functional beverage rack for use in storing a wide variety of beverage containers in a refrigerator. More specifically, in accordance with a preferred embodiment of the invention, the beverage rack can be configured to selectively store cylindrical cans, a series of bottles, or a single wine bottle. Most preferably, the rack is provided with an elongated cavity which enables the rack to hold a wine bottle, a pair of spaced longitudinal ledges for supporting a plurality of 12 ounce cans, and a set of ridges on longitudinal walls which accommodate a series of 12 or 20 ounce bottles. With this arrangement, a consumer has the flexibility to choose the particular type of beverages to be stored and organized on a single rack. The rack is preferably injection molded of plastic and can be placed in various locations within a refrigerator compartment. In accordance with the most preferred embodiment, the rack is sized to extend front-to-back on a shelf, in a crisper drawer, or the like.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
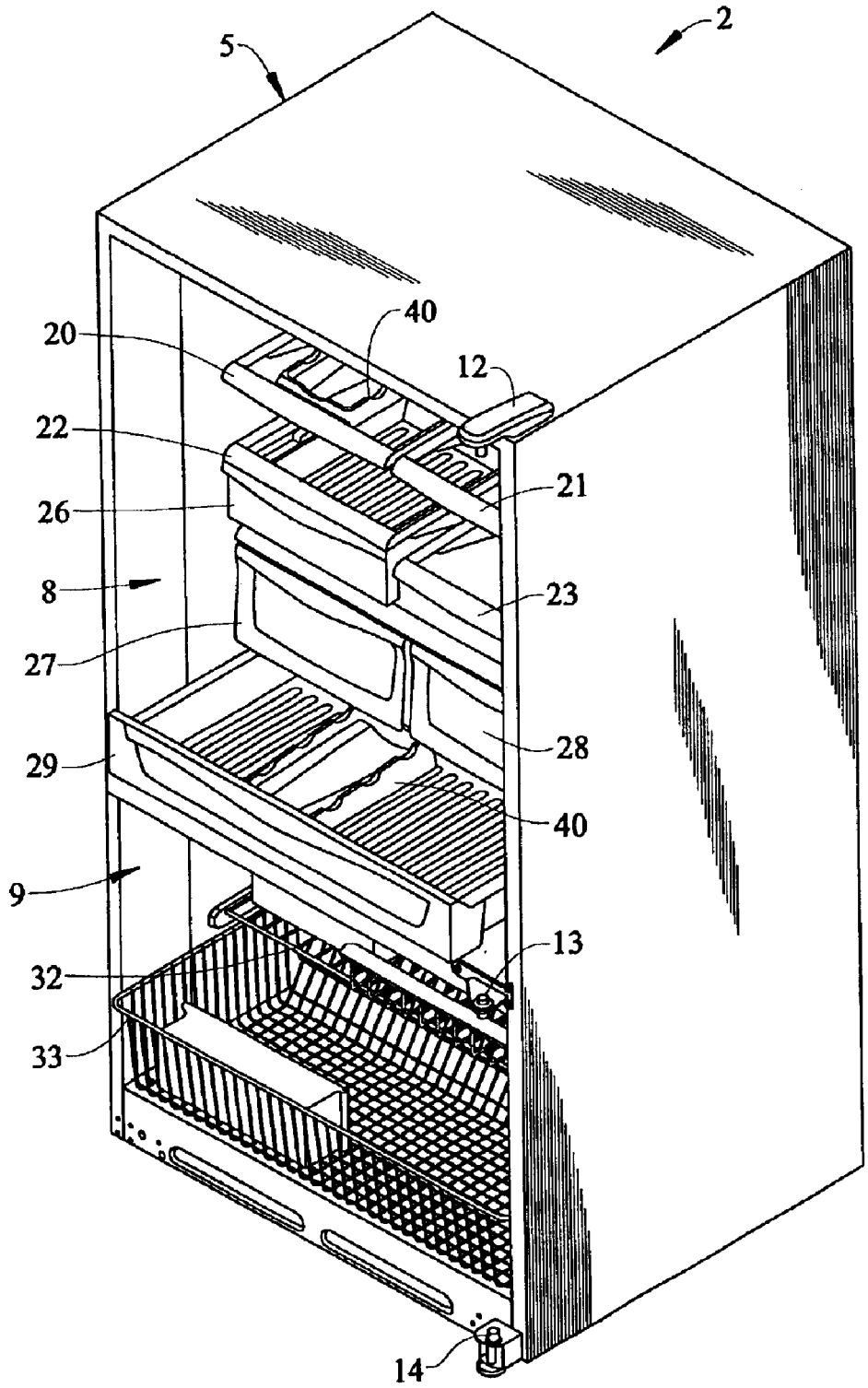
FIG. 1 is a perspective view of a refrigerator provided with the multi-functional beverage rack of the invention.

With initial reference to FIG. 1, a refrigerator associated with the present invention is generally indicated at 2. As shown, refrigerator 2 includes a cabinet 5 within which is defined an upper fresh food compartment 8 and a lower freezer compartment 9. Also depicted are upper, central and lower hinges 12–14 which are used in connection with pivotally mounting fresh food and freezer doors of refrigerator 2, with the fresh food and freezer doors not being shown in order to illustrate internal components of refrigerator 2. At this point, it should be realized that, although refrigerator 2 is shown to constitute a bottom mount style refrigerator, the invention is equally applicable to other refrigerator styles, including top mount and side-by-side units.

In the embodiment shown, fresh food compartment 8 includes a plurality of spaced shelves 20–23, as well as a plurality of storage drawers 26–29. Storage drawer 29 actually constitutes a crisper drawer which extends across substantially the entire width of fresh food compartment 8. On the other hand, freezer compartment 9 is shown to include upper and lower racks 32 and 33 for storing food items to be frozen. In any case, the present invention is particularly directed to the inclusion of one or more beverage racks 40 in fresh food compartment 8 of refrigerator 2.

Figure 2:
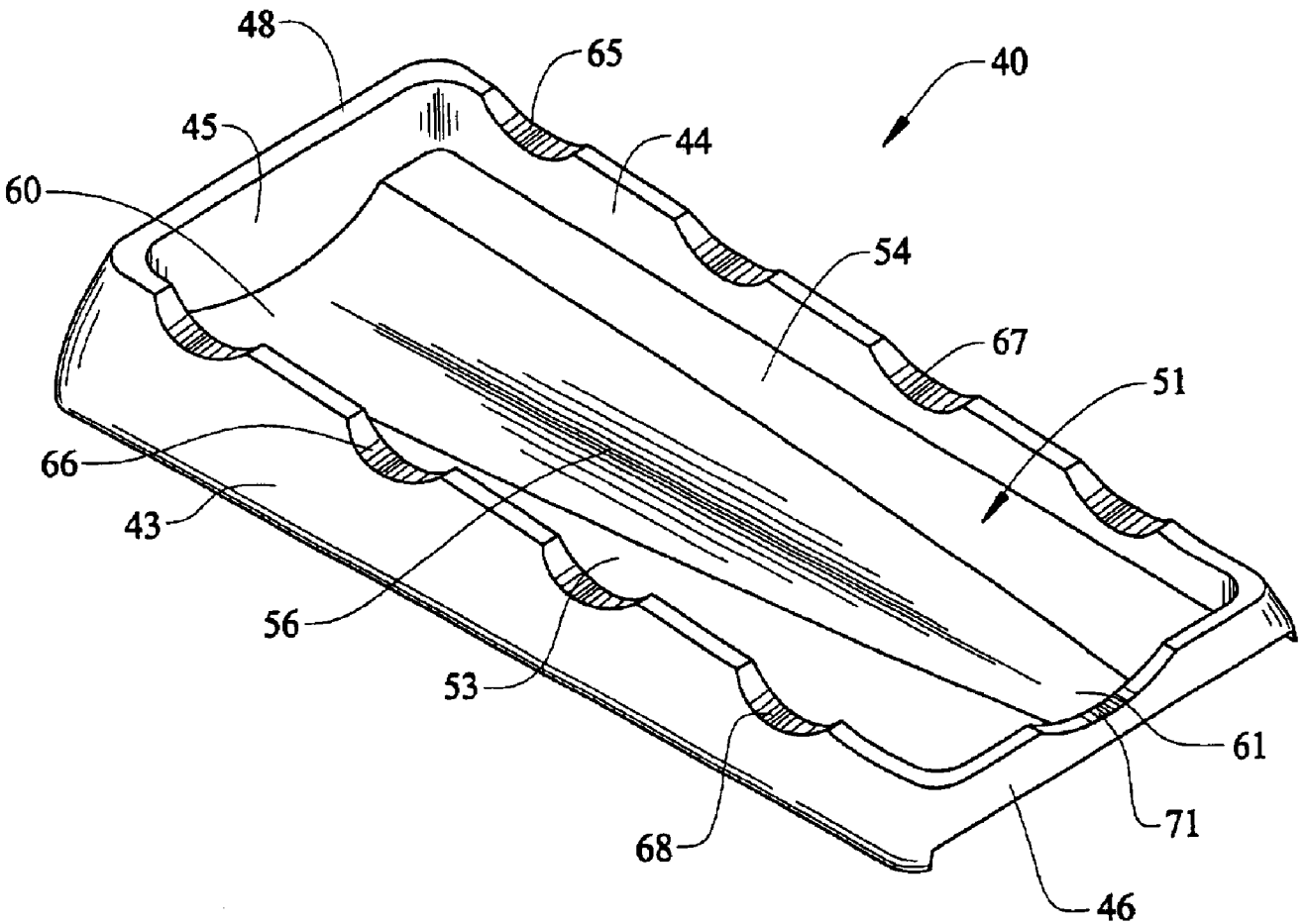
FIG. 2 is an enlarged perspective view of the beverage rack of FIG. 1.

Reference will now be made to FIG. 2 is describing the construction of beverage rack 40 in accordance with the most preferred embodiment of the invention. In general, beverage rack 40 is preferably integrally molded of plastic. Specifically, beverage rack 40 is molded with opposing, substantially parallel side walls 43 and 44, an upper or rear wall 45, and a lower or front wall 46, all of which are interconnected along an upper peripheral rim 48. Side walls 43 and 44 have a greater height adjacent upper wall 45 than at lower wall 46. Within walls 44–46, beverage rack 40 includes a base 51 which is defined by a pair of laterally spaced, forward sloping ledges 53 and 54, along with a central, elongated cavity 56 having an upper end 60 and a lower end 61. As shown, central cavity 56 laterally tapers from upper end 60 to lower end 61. Correspondingly, each of ledges 53 and 54 tapers from lower wall 46 to upper wall 45. Beverage rack 40 is also provided with various sets of opposing arcuate recesses 65–68. In addition, rack 40 is formed with a frontal arcuate recess 71 which is centrally located in peripheral rim 48 at lower wall 46.

Figure 3:
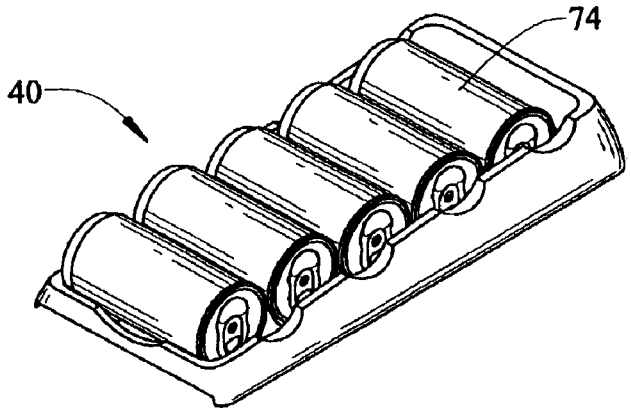
FIG. 3 is a perspective view of the beverage rack of FIG. 2 supporting a plurality of cylindrical cans.

With the above construction, beverage rack 40 can be readily utilized to support a variety of beverage containers. As shown in FIG. 3, beverage rack 40 is adapted to support a plurality of cans 74, such as typical 12 ounce soda cans 74. More specifically, each can 74 is supported upon side ledges 53 and 54. Given that side ledges 53 and 54 slope forward when beverage rack 40 is supported on a planar surface, cans 74 are automatically directed toward lower wall 46 for ease of dispensing.

Figure 4:
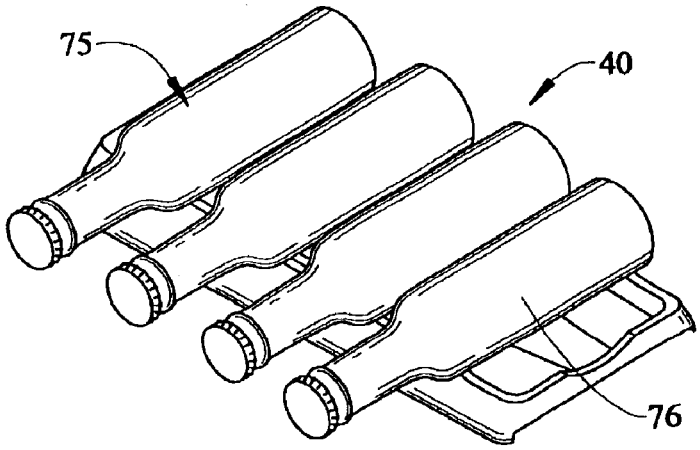
FIG. 4 is a perspective view of the beverage rack of FIG. 2 supporting a series of bottles.

As represented in FIG. 4, beverage rack 40 can also be used to support a series of glass or plastic bottles 75, such as 12 or 20 ounce beer or water bottles. Particularly, each bottle 75 includes a body portion 76 situated in a corresponding set of opposing arcuate recesses 65–68. With the sloping of beverage rack 40 forward, each bottle 75 is adequately displayed such that, even if the lowermost bottles 75 are removed, the upper bottle(s) 75 are still visible and easily accessible.

Figure 5:
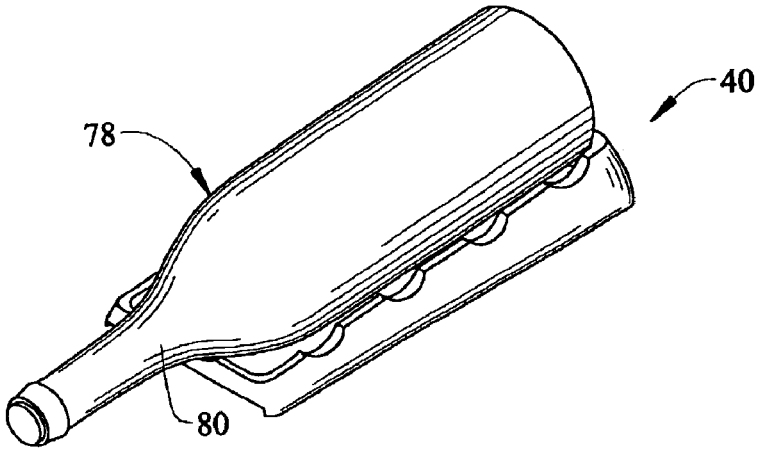
FIG. 5 is a perspective view of the beverage rack of FIG. 2 supporting a wine bottle.

As further shown in FIG. 5, beverage rack 40 is sized to accommodate a wine bottle 78. More specifically, wine bottle 78 is adapted to sit within central cavity 56, with a neck 80 of wine bottle 78 being situated in frontal arcuate recess 71. Of course, a champagne bottle could be equally supported in this fashion.

With the above description, it should be readily apparent that beverage rack 40 constructed in accordance with the present invention includes first, second and third distinct support structures that can be readily utilized to hold a wide variety of beverage containers based on selections made by respective, individual consumers. Although the actual dimensions of beverage rack 40 can vary, the most preferred embodiment depicted in the drawings has an overall length of approximately 13¾ inches (35 cm), an overall width of approximately 6⅜ inches (16.2 cm), a height at rear wall 45 of about 1⅞ inches (4.76 cm), a front height of about ⅞ inches (2.2 cm), an interior length between rear wall 45 and front wall 46 in the order of 12¾ inches (32.4 cm), an interior width between side walls 43 and 44 of 4⅞ inches (12.4 cm), a depth for central cavity 56 at rear wall 45 in the order of 11/16 inches (1.75 cm) with the depth tapering off to front wall 46, and a maximum depth for each arcuate recess 65–68 of approximately ⅜ inches (0.95 cm). In any case, beverage rack 40 is preferably sized to be snugly supported on any one of a plurality of shelves 20–23, or even in select ones of drawers 26–29. For instance, again referencing FIG. 1, beverage rack 40 is preferably sized to snugly fit between front and rear peripheral rim portions (not labeled) of shelf 20 and/or in drawer 29. Of course, when placed in drawer 29, beverage rack 40 is not intended to be utilized in connection with supporting wine bottle 78. In any case, it is simply important to note that the individual consumer has the option of supporting a wide variety of beverage containers on beverage rack 40, and beverage rack 40 can be conveniently, selectively supported in a plurality of locations within refrigerator 2 in accordance with the invention.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. A refrigerator comprising:

a cabinet within which is defined a fresh food compartment and a freezer compartment;

a plurality of shelves arranged in the fresh food compartment;

at least one drawer provided in the fresh food compartment; and a beverage rack including first, second and third distinct support structures, with the first support structure being used to hold various beverage containers of a first type, the second support structure being adapted to hold a plurality of a second type of beverage container, and a third support structure for holding a third type of beverage container wherein, when one of the first, second and third support structures is used to hold a respective beverage container, at least another one of the first, second and third support structures is blocked by the respective beverage container from use.

2. The refrigerator according to claim 1, wherein the first type of beverage containers constitutes cans, the second type of beverage container constitutes bottles, and the third type of beverage container is defined by a wine bottle.

3. The refrigerator according to claim 1, wherein the beverage rack includes a pair of side ledges for supporting beverage containers of the first type.

4. The refrigerator according to claim 3, wherein the side ledges slope forward of the beverage rack.

5. The refrigerator according to claim 3, wherein the beverage rack includes various sets of opposing arcuate recesses for supporting the second type of beverage containers.

6. The refrigerator according to claim 5, wherein the beverage rack includes a peripheral rim, each of the various sets of opposing arcuate recesses being formed in the peripheral rim.

7. The refrigerator according to claim 1, wherein the beverage rack is supported within the drawer.

8. The refrigerator according to claim 1, wherein the beverage rack is supported directly on a select one of the plurality of shelves.

9. A refrigerator comprising:

a cabinet within which is defined a fresh food compartment and a freezer compartment a plurality of shelves arrange in the fresh food compartment;

at least one drawer provided in the fresh food compartment; and a beverage rack including first, second and third distinct support structures, with the first support structure being used to hold various beverage containers of a first type, the second support structure being adapted to hold a plurality of a second type of beverage container, and a third support structure for holding a third type of beverage container, wherein the beverage rack includes a central, arcuate cavity for holding the third type of beverage container.

10.The refrigerator according to claim 9, wherein the arcuate cavity tapers from one end of the beverage rack to an opposing end of the beverage rack.

11. The refrigerator according to claim 9, wherein the beverage rack further includes a frontal arcuate recess within which a portion of the third type of beverage container is adapted to rest.

12. A beverage rack for use in a refrigerator comprising:

first support means for holding various beverage containers of a first type;

second support means for holding a plurality of a second type of beverage containers; and third support means for holding a third typo of beverage container, wherein the first, second and third support means include distinct structure for holding beverage containers in three distinct configurations wherein, when one of the first, second and third support means is used to hold a respective beverage container, at least another one of the first, second and third support means is blocked by the respective beverage container from use.

13. The beverage rack according to claim 12, wherein the first type of beverage containers constitutes cans, the second type of beverage containers constitutes bottles, and the third type of beverage container is defined by a wine bottle.

14. The beverage rack according to claim 12, wherein the beverage rack includes a pair of side ledges for supporting beverage containers of the first type.

15. A beverage rack for use in a refrigerator comprising: first, second and third distinct support structures, with the first support structure being used to hold various beverage containers of a first type, the second support structure being adapted to hold a plurality of a second type of beverage container, and a third support structure for holding a third type of beverage container, wherein the beverage rack includes a pair of side ledges for supporting beverage containers of the second type thereon, and wherein both the first support structure and the side ledges slope forward and downward of the beverage rack.

16. The beverage rack according to claim 15, wherein the beverage rack includes various sets of opposing arcuate recesses for supporting the second type of beverage containers.

17. The beverage rack according to claim 16, wherein the beverage rack includes a peripheral rim, each of the various sets of opposing arcuate recesses being formed in the peripheral rim.

18. The beverage rack according to claim 16, wherein the beverage rack includes a central, arcuate cavity for holding the third type of beverage container.

19. The beverage rack according to claim 18, wherein the arcuate cavity tapers from one end of the beverage rack to an opposing end of the beverage rack.

20. The beverage rack according to claim 18, wherein the beverage rack further includes a frontal arcuate recess within which a portion of the third type of beverage container is adapted to rest.

* * * * *